United States Patent [19]

Baker et al.

[11] Patent Number: 4,867,063

[45] Date of Patent: Sep. 19, 1989

[54] METHOD AND APPARATUS FOR DISPENSING POWDER IN A PRINTING PRESS

[76] Inventors: Gerald Baker, 1167 Pleasant Ct., Batavia, Ill. 60510; Craig Beierwaltes, 3308 Maring Ct., Rolling Meadows, Ill. 60008; William Gardner, 1004 N. Plum Grove Rd., Schaumburg, Ill. 60195; Charles Weber, 1979 W. Alder Dr., Hoffman Estates, Ill. 60195

[21] Appl. No.: 920,620

[22] Filed: Nov. 25, 1986

[51] Int. Cl.[4] ..... B41F 23/06

[52] U.S. Cl. ..... 101/424.2; 101/484

[58] Field of Search ..... 101/416 B, 416 R; 118/DIG. 1, 663, 697, 308; 239/155

[56] References Cited

U.S. PATENT DOCUMENTS

| | | | |
|---|---|---|---|
| 3,434,416 | 3/1969 | Testone | 101/416 R |
| 3,606,087 | 9/1971 | Ortman | 101/416 B |
| 4,392,611 | 7/1983 | Bachman et al. | 239/155 X |
| 4,515,105 | 5/1985 | Danta et al. | 101/416 B |
| 4,614,300 | 9/1986 | Falcoff | 118/697 X |
| 4,630,773 | 12/1986 | Ortlip | 239/155 X |

FOREIGN PATENT DOCUMENTS

| | | | |
|---|---|---|---|
| 2637875 | 3/1978 | Fed. Rep. of Germany | 101/416 B |

*Primary Examiner*—Clifford D. Crowder

*Attorney, Agent, or Firm*—Hill, Van Santen, Steadman & Simpson

[57] ABSTRACT

An improved powder delivery system for use in dispensing powder to a printing press. The improvements include an agitator system for the powder reservoir, a wiper block for use with a curved feed roller, a split air flow amplifier which is openable for cleaning, a flow-through rotary manifold for distributing powder to press and an improved powder spray block. The foregoing elements minimize the flow restrictions and enhance air and powder flow through the system. A control panel is provided at the operator's console which is remote from the mounting position for the powder delivery apparatus. The control panel provides for, among other things, the delivery of powder at a fixed rate regardless of press speed or in accordance with variations in press speed. For example, in accordance with a factory determined linear relationship or an operator entered relationship. Such data can be stored for future reference and use.

11 Claims, 6 Drawing Sheets

18
22b
22a
22c
40
44
48
42
32
24
44
32
87
86
70
32
36
30
88
72
70
76
82
86
34
58
64
74
80
56
62
38
66
60
90
78
84
87

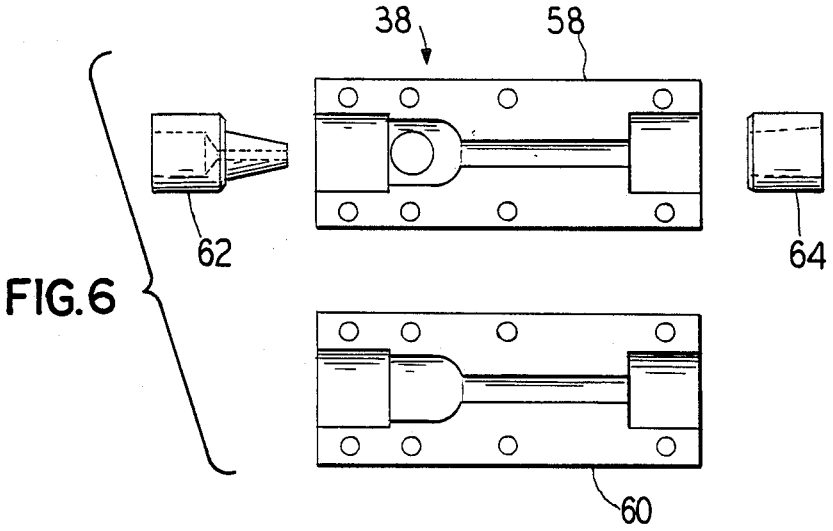
FIG.6
FIG.7
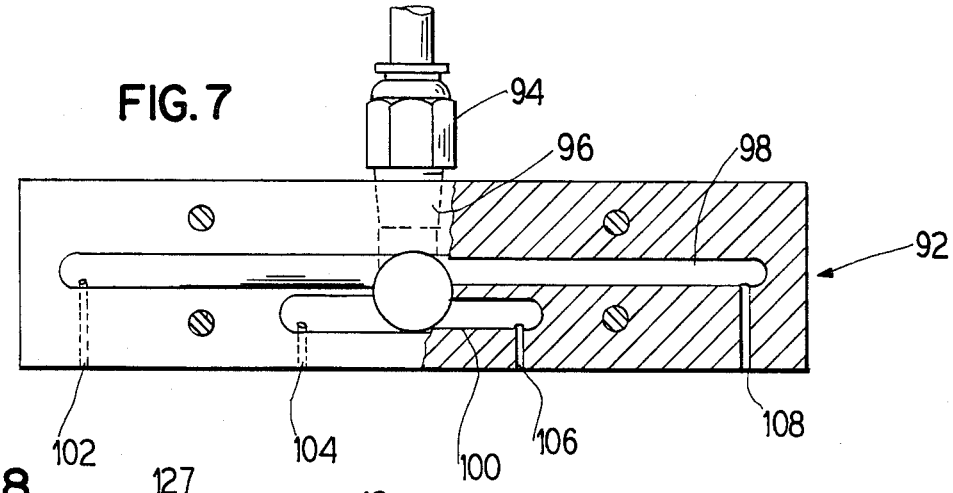
FIG.8
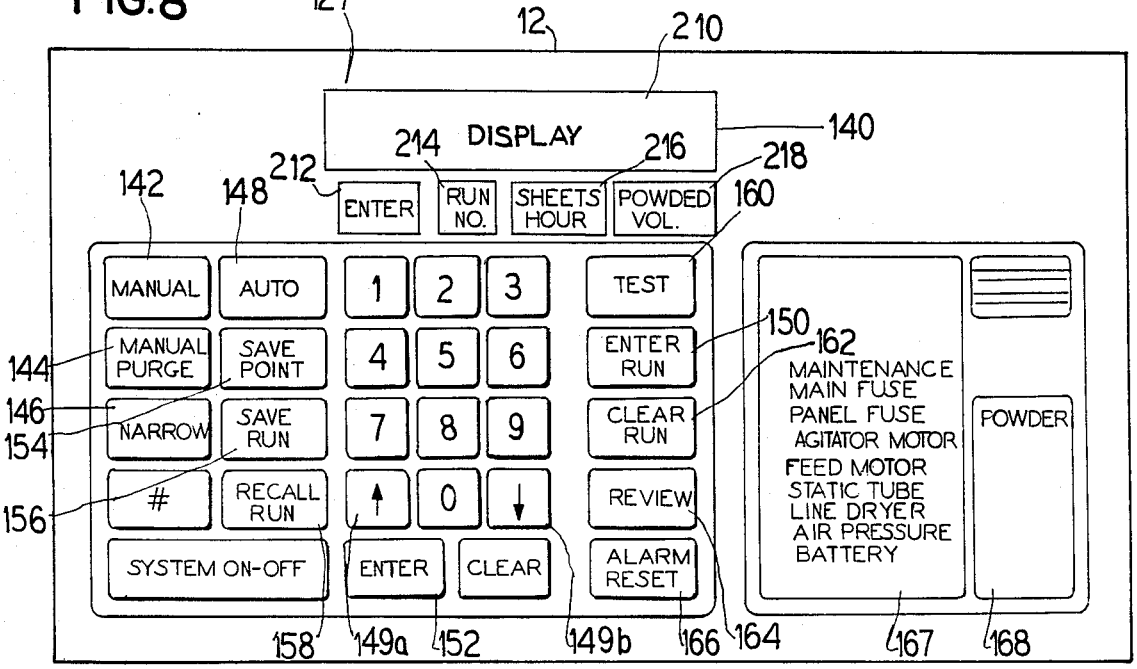

AUTOMATIC

260
OFF LINE ?
YES
262
SENSE SPEED
264
CHANGE ?
268
LOAD BUFFER FROM MEMORY
266
CLEAR ?
270
NEW POWDER VOLUME ?
272
LOAD BUFFER FROM KEY BOARD
274
?
276
?
278
SAVE POINT ?
280
STORE POINT DATA
282
SAVE RUN ?
284
STORE RUN DATA
286
ENTER RUN ?
288
GET KEY BOARD DATA
STORE DATA
290
292
CLEAR RUN ?
294
GET KEY BOARD DATA
296
CLEAR MEMORY
298
REVIEW ?
300
GET KEY BOARD DATA
302
DISPLAY STORED DATA
304
RECALL RUN ?
306
LOAD BUFFER FROM MEMORY
308
SET ON LINE FLAG

METHOD AND APPARATUS FOR DISPENSING POWDER IN A PRINTING PRESS

BACKGROUND OF THE INVENTION

This invention relates to an apparatus for use with a printing press to apply powder to printed materials, and more particularly, to a device for controllably spraying such powder onto printed sheets.

In the printing of sheets it is desirable to apply a powder to printed sheets to aid in drying printed ink and in spacing the printed face of one sheet from the back of another sheet when the sheets are stacked after printing.

In one system, powder (such as cornstarch) is stored in a reservoir, dispensed from the reservoir and sprayed onto the sheets. In an improved version an electrostatic field is created between the sprayer and printed sheet, by an electrostatic discharge tube, to assist in dispensing particles onto the sheet by charging powder particles as they travel to the sheet.

In systems such as these the reservoir feeds powder to a knurled feed roller from which powder is removed by flowing air and delivered through tubing to spray blocks. One apparatus of this type is sold by Electro Sprayer Systems, Inc., 4225 Transworld Road, Schiller Park, Ill. 60176 under the trademarks "Electro Sprayer System" and "Electromat 7700".

In systems of this type it has been found that the powder tends to cake or clog various components, such as the reservoir and parts of the air system, and that it is necessary to clean the system periodically.

It is an object of this invention to provide an improved reservoir powder agitator system for use in minimizing clogging.

In one particular system an air amplifying device has been provided by a company identified as Vaccom Company, Inc., Bldg. 23, Endicott Street, Norwood, Mass. 02062. However in that device the powder tends to clog and reduce delivery of the powder. This device is not easily unclogged or maintained.

It is therefore one object of this invention to provide an air flow system, such as an air amplifier, which can be readily cleaned and cleared of clogged powder.

In prior systems powder is delivered from the reservoir to the feed roller via a wiper block. However, it was noted that even when the feed roller was stopped, that is not rotating, small amounts of powder continue to drop off from the feed roller. This small amount of powder dispensing was determined to be undesirable.

It is therefore another object of this invention to provide a feed system which minimizes dispensing of powder when the feed roller is stopped.

In some systems it has been found that there have been significant air flow and powder distribution problems due to disruptions in various flow lines such as right angle turns. In particular, prior distribution manifolds have had right angle turns which are believed to have caused some problems in air flow powder distribution.

One such manifold is a rotary manifold manufactured by Weko GmbH & Co. of West Germany, which has a counter flow or a U-shaped flow path between a central inlet and circumferential outlets. This flow is believed to impede air flow and powder distribution.

It is therefore another object of this invention to provide an air distribution system and particularly a manifold system which minimizes air flow problems and undesirable changes in air flow and powder distribution.

In connection with the spraying of powder, in some prior systems the spray blocks at the printing press tended to clog.

It is therefore another object of this invention to provide an improved spray blocks which enhances spraying and minimizes clogging.

In prior systems powder dispensing controls have been located at a position remote from the printing press operator station or console. However, it has been found to be desirable to locate the powder dispensing controls at the printing press operator station.

Furthermore, in some systems it was required that the powder system be manually set for dispensing powder for each job. In addition, the powder dispensing rate had to be reset when the press speed was changed. Thus, the operator had to manually raise or lower the powder dispensing rate based on his experience and press speed.

It is yet a further object of this invention to provide means for automatically adjusting powder dispensing based upon changes or variations in press speed, and it is desirable to provide a device whereby previous production runs can be stored so as to permit recall of the powder specifications for each job.

These and other objects of this invention will become apparent from the following disclosure and appended claims.

SUMMARY OF THE INVENTION

There is provided by this invention an improved electrostatic spraying system which meets the foregoing objects. This invention includes an improved powder agitator system and an improved wiper block shaped to cooperate with the feed roller for dispensing powder from the roller only during rotation so as to prevent undesired delivery of powder. The system also includes an improved air flow system and amplifying device for drawing powder from the feed device and dispensing the powder to a distribution manifold. The amplifier is "split" or openable for maintenance so as to be readily cleaned of clogged powder. A circularly-shaped distribution manifold is also provide which includes a central inlet, conically-shaped flow-through distribution chamber and circumferentially positioned distribution outlets which exhibit a smooth flow so as to minimize velocity losses. In this manifold the outlet flow is in the same direction as the inlet flow. The outlets connect to tubing that connects to spray blocks having an inlet which opens into enlarged passageways or runners that in turn communicate with spray orifices. This again minimizes air flow losses while enhancing spray distribution. Selective operation of the spray blocks is achieved by opening and closing certain distribution manifold outlets.

Electronic control means is provided for selectively varying the powder dispensing rate in relation to printing press speed. The electronic control means provides for selectively setting operation of the powder system so as to dispense powder only at a selected rate regardless of press speed (manual mode), for varying powder rate linearly with press speed (factory preset mode), or for varying a powder rate in accordance with predetermined values set by the operator (operator mode). The powder apparatus controls are located at the press control console and additional manual controls are located at the point where the powder apparatus is mounted to the press. Furthermore, various sensors are provided at the powder apparatus mounting position for monitoring the functions of the powder apparatus and comparing those functions to preselected values.

These and other features of this system will be described in detail hereinafter.

BRIEF DESCRIPTION OF THE DRAWINGS

FIG. 6 is an assembly view showing the component parts of the air amplifier system;

FIG. 7 is a plan view showing components of the sprayer block;

FIG. 8 is a front view of the control panel located at the press operator position for operating the spray system;

DESCRIPTION OF THE PREFERRED EMBODIMENT

Figure 1:
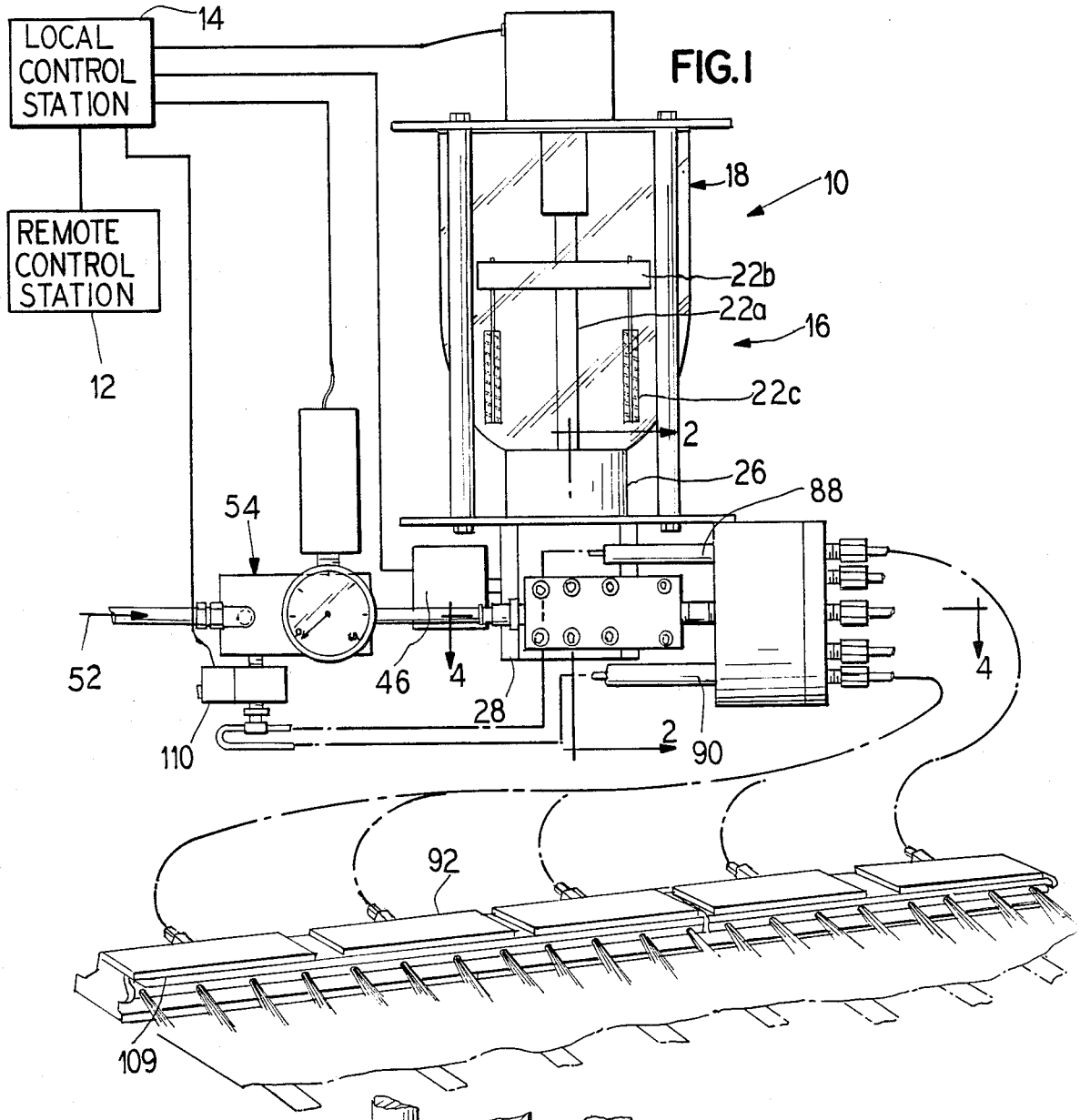
FIG. 1 is an elevational view showing the major components of the powder spraying system including the control system, reservoir, air distribution system, and spraying system.

Referring now to the drawings, the powder delivery system 10, generally, includes the remote operator control panel 12, an on-site control panel 14, and the powder delivery apparatus 16. The powder delivery apparatus 16 includes a powder reservoir system 18, which includes: a reservoir bowl 20; a rotatable agitator 22 which includes a rotatable shaft 22*a* on which is mounted a transverse arm 22*b* and downwardly extending brushes 22*c*; and an internal rotatable wiper block sweeping assembly 24. The bottom of the reservoir 18 connects to a collar 26 for delivery of powder to the rotatable feed device 28.

Figure 2:
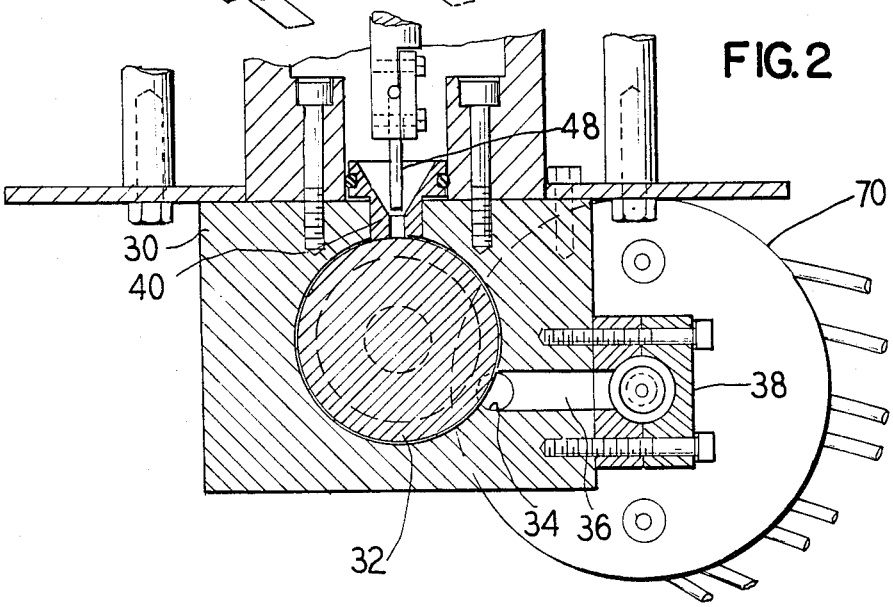
FIG. 2 is a sectional view taken along line 2—2 of FIG. 1 showing the base of the reservoir, the feed system, and the air amplifier system.

The feed device 28, shown in FIG. 2, includes a block 30 within which a knurled feed roller 32 is journalled for rotation in what is shown as the clockwise direction. An inlet air passageway 34 extends from a position external of the block 30 and along a line generally tangential to the feed roller 32. An outlet line 36 connects the inlet line 34 with a vacuum amplifier assembly 38. Powder is delivered from the reservoir through a wiper block assembly 40 that is mounted in the collar 26 and positioned to deliver powder directly to the top of the feed roller 32.

Figures 3, 3A, 4, 5:
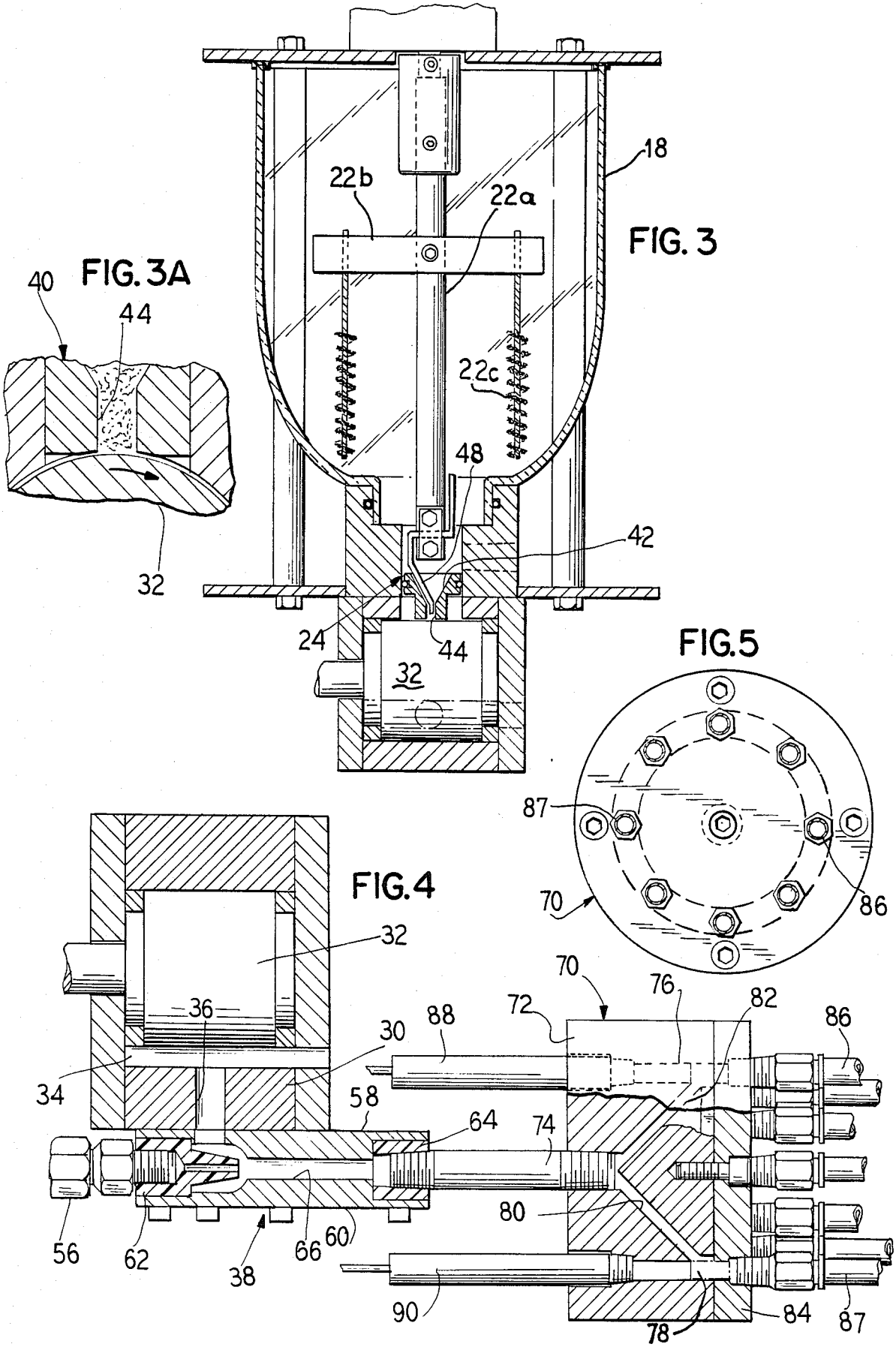
FIG. 3 is an enlarged view showing the reservoir and feed system.
FIG. 3*a* is a greatly enlarged sectional view taken along line 3*a* of FIG. 3 showing the wiper block system.
FIG. 4 is a sectional view taken along line 4—4 of FIG. 1 showing the air flow paths through the feed system, an air amplifier system, and a rotary manifold system.
FIG. 5 is an end view showing various ports in the rotary manifold system.

Referring to FIGS. 2, 3 and 3*a*, it is seen that the wiper block has a conical inlet 42 and a generally straight or cylindrical discharge passageway 44. The bottom face of the wiper block 40 is curved with the same radius of curvature as the feed roller. Thus the wiper block seats on and forms a tight seal with the feed roller 32. Drive motor 46 rotates the feed roller. The agitator shaft 22*a* rotates the wiper arm 48 to keep the collar and wiper block area clear and free of clogged powder.

Referring now to FIG. 4, a split vacuum amplifier 38 is shown attached to the feed block 30 in communication with the exit passageway 36. Referring to FIGS. 1 and 4, compressed air, sometimes referred to as shop air, is supplied via line 52 to an air pressure gauge and regulating apparatus 54 and from there to the inlet 56 and the split amplifier.

The split amplifier includes a two-part housing 58 and 60, a nozzle-like inlet 62, and an outlet 64. The amplifier defines a passageway 66 which extends between the inlet and outlet. The inlet 62 and outlet 64 are fabricated of a sealable material, such as Teflon, such that when positioned in the housing parts 58 and 60, which are then closed, they seal to the inlet and outlet parts and prevent air leakage from the housing parts.

In operation compressed air is delivered to the inlet 62 and exits at a high velocity. The high velocity creates a venturi- or vacuum-like effect drawing external air from outside the feed device through passageway 34, which picks up powder on the feed roller 32 and the powder/air mixture is delivered through passageway 36 into the amplifier, into the passageway 66 and out of the amplifier through the exit 64.

From FIG. 6 it is seen that the split amplifier may be serviced by merely separating the two halves of the amplifier by removing various of the mounting screws and thereby opening the amplifier for cleaning. Thus the amplifier can be easily cleaned and then remounted easily. Air and powder exiting the split amplifier 38 is delivered to the flow-through rotary manifold 70. The manifold is fabricated from a manifold block 72 which has a central powder receiving opening 74, a plurality of radially and symmetrically positioned distribution passageways, such as 76 and 78, and a conically shaped chamber 80 that extends between the central passageway 74 and the distribution passageways 76 and 78. A cone 82, which defines a conical distribution chamber in combination with the block 72, is provided and is secured to the manifold cap 84. The cap 84 has a plurality of conduits, such as 86 and 87, that extend around the cap and are aligned with passageways, such as 76 and 78. A pair of passageway closing air cylinders, such as 88 and 90, are secured to the back end of the manifold block and are positioned to extend into the selected passageways, such as 76 and 78, for closing only those two ports. In other words, by operation of the cylinders 88 and 90 the passageways 76 and 78 and connectors 86 and 87 are closed.

In operation, the air/powder mixture exiting the amplifier via exit port 64 flows into the manifold and is spread by the conically shaped chamber 80 and cone 82 to the various connectors, such as 86 and 87. Each of the connectors is connected to tubing, which extends to a spray block, such as 92, as shown in FIG. 7. The inlet 94 to the spray block receives the powder and compressed air which is then delivered via an L-shaped passageway 96 to runners or a manifold arrangement. In the manifold arrangement there is provided an elongated runner 98 and a shorter runner 100. Powder entering the runners 98 and 100 then flows to the various spray orifices 102, 104, 106 and 108. This particular configuration provides a low pressure drop and low reduction in velocity.

Referring to FIG. 1, a large number of spray blocks similar to 92 are provided, each in communication with one of the connectors in the rotary manifold. Thus if there are eight connectors there would be eight spray blocks and thirty-two spray orifices.

The air cylinders 88 and 90 in the rotary block 70 can be operated to close two of the tubes going to the spray blocks. Preferably the two tubes to be closed connect to the outer two spray blocks so that either all eight spray blocks are in operation or only the inner six are in operation and the outer two are not.

An electrostatic discharge tube 109 is positioned forwardly and above the spray blocks, such as 92.

An air solenoid mechanism 110 connects the air source 52 to the cylinders 88 and 90.

In operation, powder in the reservoir 18 is constantly mixed and delivered to the wiper block 40. Powder flowing through the wiper block 40 enters the feed mechanism. Powder falling on the feed roller 32 is transported to the passageways 34 and 36 where powder entrained with air drawn from the feed mechanism by the amplifier 38 and into the rotary manifold 70. There the powder flows through the manifold, from one side to the other, and is distributed from the various connectors to a spray block and from the spray block through the runners to the spray orifices.

As can be seen, air and powder flow is through the device there and there are very few flow restrictions in the sense of sharp corners or reduced areas. Thus the flow through the device is effective and provides for an optimum delivery of the powder.

In addition, it can be seen that the device can be readily cleaned by opening the split amplifier and also by opening the rotary manifold. Moreover, flow to the outer two spray blocks can be controlled via the cylinders 88 and 90. Furthermore, the wiper block contacts with the feed roller, is self adjusting to the roller shape, accurately meters powder to the feed roller and prevents flow of the powder when the feed roller is stopped.

Figure 9:
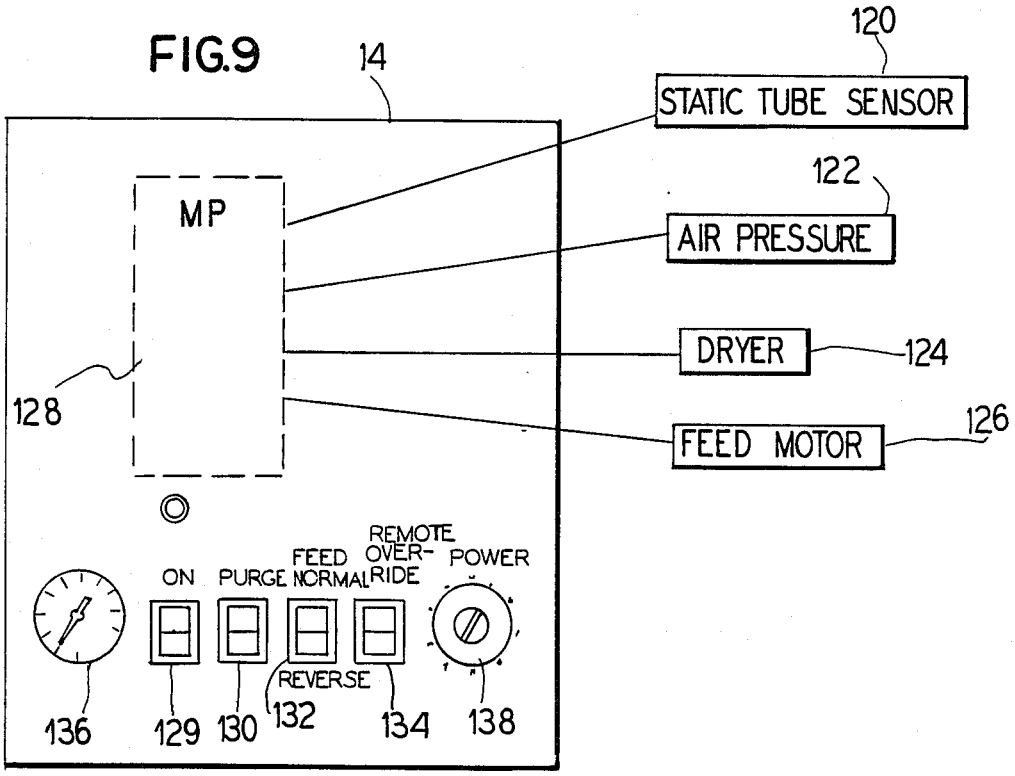
FIG. 9 is a front view of a manual control panel located at the sprayer system position mounted on the press.

Sensors monitor the operation of various portions of the device. With reference to FIG. 9, sensor 120 monitors operation of the electrostatic discharge tube, sensor 122 monitors air pressure, sensor 124 monitors operation of an air dryer, and sensor 126 monitors operation of the feed motor 46. The sensors connect to a microcomputer chip 128 (Intel No. 8751) at the on-site control panel 14 and the status information is also conveyed to the remote station 12.

The on-site control system 14 also includes several manual functions. First, there is provided an on/off switch 129 and an air purge activating switch 130 for blowing air through the system. Switch 132, which permits reversal of the feed motor 46 for cleaning the feed mechanism, and a remote override 134 permits the remote control station to be overridden in favor of local control.

In addition, an air gauge lS6 displays air pressure, and a feed drive motor control 138 is provided for controlling the operating speed of the feed motor. Using this control panel alone, delivery of powder can be manually controlled.

Referring now to FIG. 8, there is shown a face panel 12 for the remote station. In operation, the device can be set by entering the manual mode, which means that a given selectable amount of powder will be dispensed regardless of press speed. This value will be shown at window 140. The manual mode can be entered by pressing the manual selector 142. The system can be purged manually by entering the manual purge via selector 144, and the width of the spray, namely deactivating the outer two spray heads, can be activated by the selector switch 146. The automatic mode is activated by depressing selector 148. In that mode the powder is delivered according to an initially set factory predetermined linear relationship. In that relationship no powder is dispensed at zero press speed and powder dispensing increases linearly thereafter with press speed.

A display unit 210 is provided to display data entered from the keyboard, and also to display data recalled from memory for review. Several indicator lights 212–218 are provided, and they light up their indicator legends individually to display prompts to the operator, prompting him to enter data, or to indicate the significance of data recalled from memory and displayed in the display 210.

In the manual mode with the system operating or being on-line the powder volume or sheets per hour can be changed by either using keypad entries with numerals 1– and the enter key or the up/down arrows indicated at **149*a* and 149*b***. Thus for example, the operator could increase the powder volume above or below the predetermined linear rate.

The system can also be operated in the automatic mode in Which powder volume varies with press speed. These changes can either be entered off-line (while the press is not running) or on-line.

Figure 11:
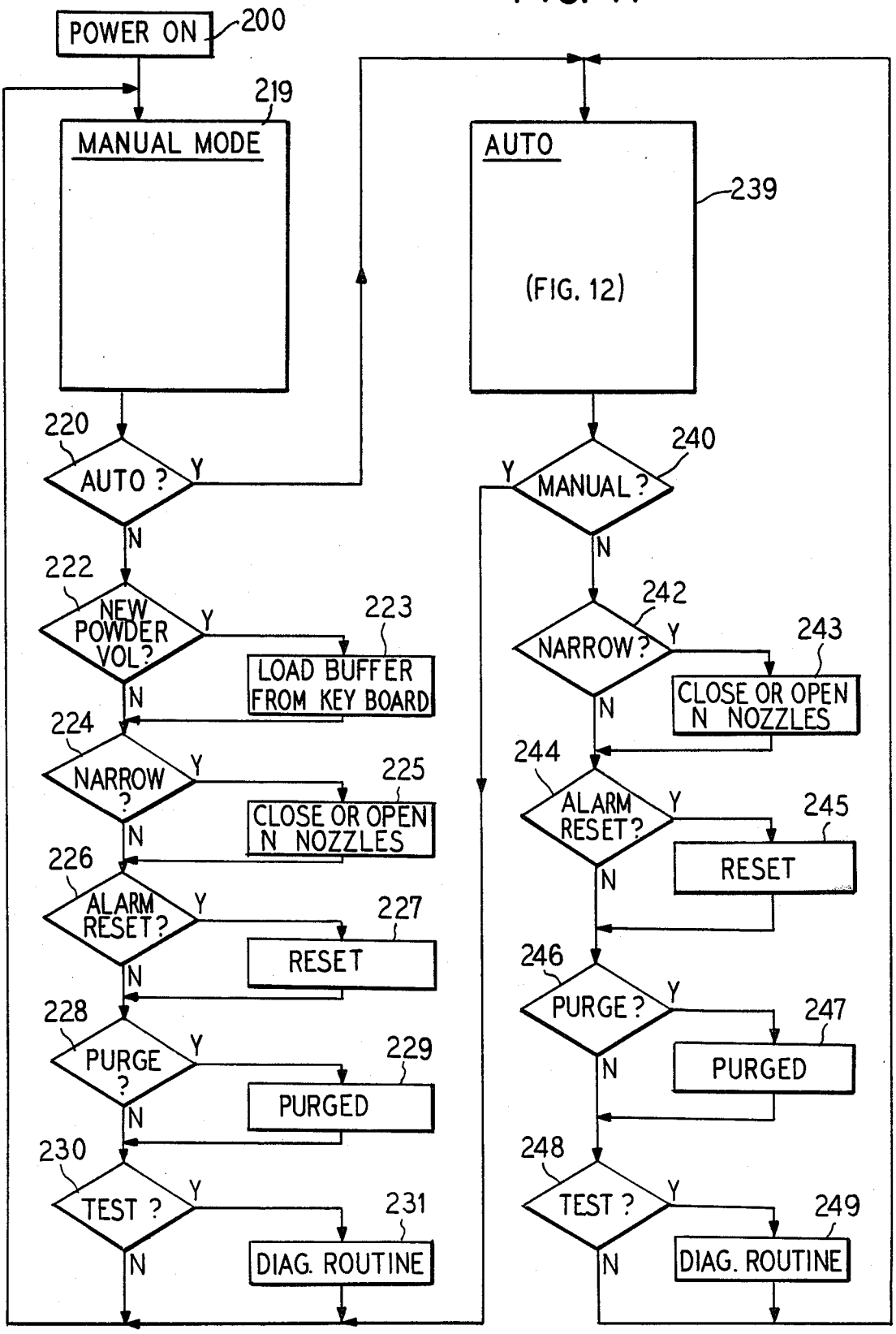
FIG. 11 is a flow diagram showing operation of the electronic control system.
Figure 12:
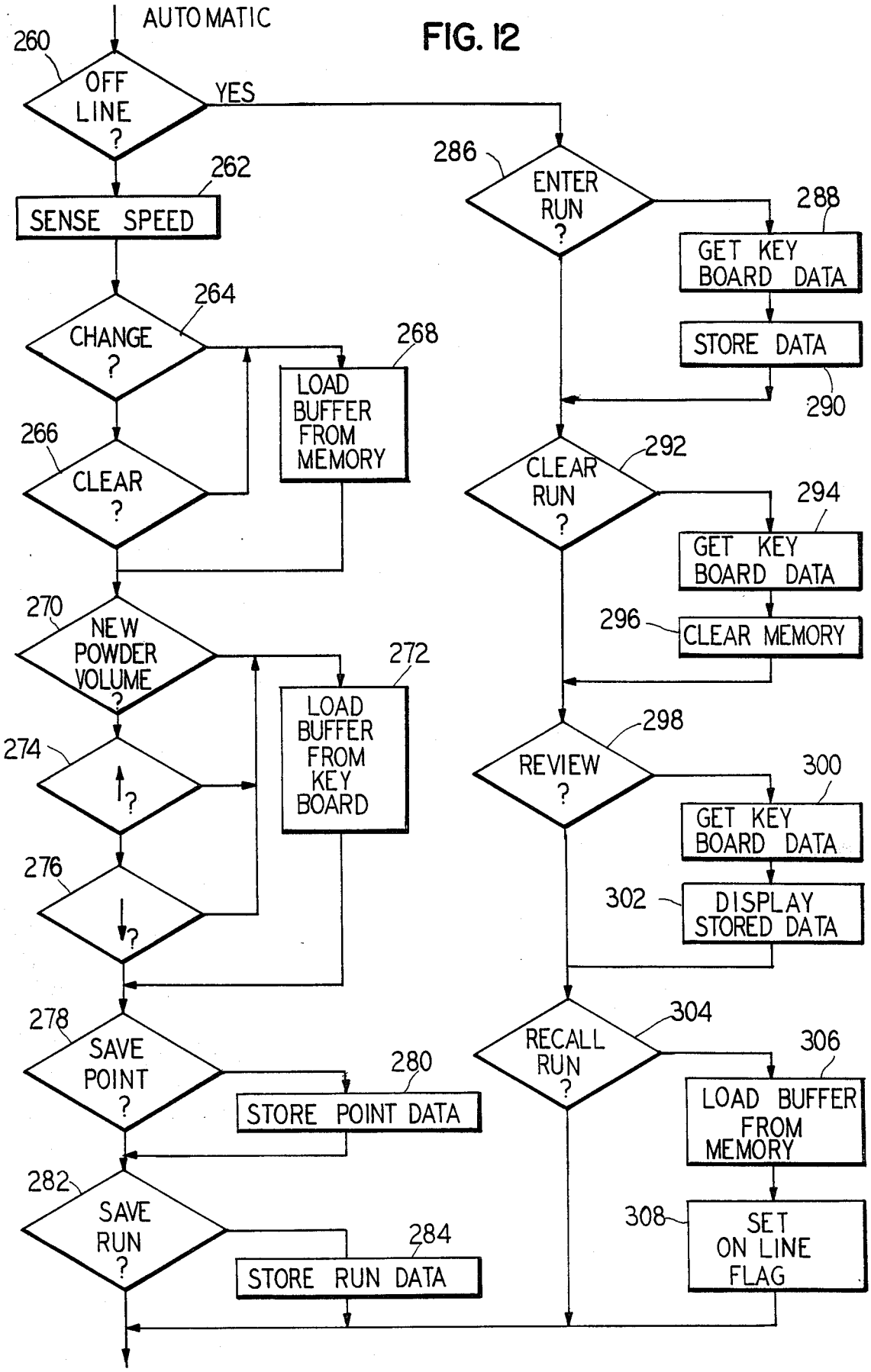
FIG. 12 is a flow diagram showing operation of the control system in an automatic mode.

FIGS. 11 and 12 illustrate flow diagrams for the sequence of operations performed by the apparatus. Preferably a microcomputer, such as Intel Model No. 8751, is used to execute operational steps, and the units of the flow diagrams in that case represent program steps. Alternatively, the units of the flow diagram can represent structural units provided to perform the required functions in sequence.

In the off-line mode, the run is entered by depressing keypad 150, the increase in the change in powder volume is entered by the keypad numerals and enter key 152 or the up/down arrows **149*a* and 149*b*. If it is then determined that it is desirable to save that particular data point, that point can be saved by depressing key 154. This will then modify the initial curve so as to linearly indicate that data point. If it is desired to save the run or modified curve for future reference, the save run key 156** is depressed.

In the on-line automatic mode, the new powder volume is entered using the keypad or the up/down arrows, and the save point key 154 is activated to save the points. The sequence is then repeated for different press speeds as desired. If all of the points of the run are to be saved, then the save run key 152 is depressed and the run data is saved, at a memory location corresponding to a run number entered through the keyboard.

In the automatic on-line mode, data for a designated run can be recalled by depressing button 158 and entering the appropriate run number in response to the prompt indicator 214.

In the off-line mode. the entry keys 160, 150, 162, 164 and 166 are used. Key 160 activates a diagnostic test system; key 150 enters run data off-line as explained above: key 162 clears an entire run: key 164 permits review of a run; and alarm reset key 166 resets any alarm condition from sensors 120, 122, 124 and 126.

The status of various maintenance functions is identified in panel 167 in response to the sensors 120, 122, 124 and 126. The powder level is shown in the powder level indicator 168.

Figure 10:
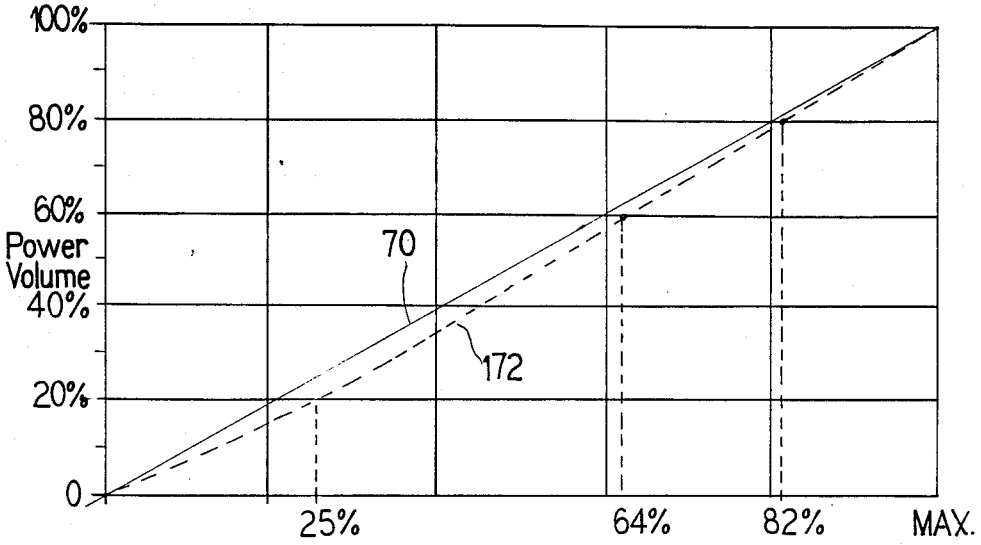
FIG. 10 is a graph showing the relationship between the press speed and powder dispensing rate for both predetermined and selected relationships.

In FIG. 10, a graph is shown having a factory predetermined linear curve 170 and an operator set curve 172 having new data points entered at 20%, 60% and 80% powder dispensing rate. As is seen, the initial curve has been modified to accommodate the new data points. Furthermore, the controls can be set so as to accept data points which are within a predetermined acceptable tolerance of a prior relationship, such as ±10% a previous dispensing rate at a given press speed.

Referring now to FIG. 11, operation of the system will be described.

The machine is initially powered on as indicated at block 220. The machine is preferably provided with a battery back-up so as to retain stored data in memory. The machine is first placed in a manual mode in which the unit 219 receives control and the following conditions are established:

1. The powder volume is initially set to a default value, such as the last value set in the manual mode or a predetermined value;
2. The powder volume does not vary with press speed;
3. A new powder volume may be entered via the keyboard when the enter selector is depressed; or
4. The initial powder volume may be increased or decreased via the keyboard using the up/down arrow on the keypads, such as 149*a* and 149*b*.

From this condition, operation of the manual mode is checked in accordance with the flow chart beginning with unit 220. If unit 220 determines that the automatic mode request key has not been pressed, then the unit 222 checks to determine whether a new powder volume has been entered through the keyboard, by the up/-down arrow keys, or via the numeric keypad and the enter button 152. If so, unit 223 causes the current powder volume to change instantaneously. Then unit 224 checks whether or not nozzle width button has been pushed and unit 225 performs the adjustment. Then unit 226 checks whether or not the alarm 166 has been reset in case of an alarm condition and unit 227 performs the reset. Then unit 228 checks whether or not a purge has been operated and unit 229 performs the purge. Then unit 230 checks for a self-diagnostic mode and unit 231 operates to perform the diagnostic routine. If the foregoing are negative or have been complied with, then the operation recycles to the beginning of the manual mode again.

In the automatic mode, unit 239 receives control and the system may be operated so as to first revert to the last automatic setting. If appropriate, a new data point can be entered and saved or the new data run can be saved. Also, a recall can be activated to bring up a new run for which data has previously been stored. Also, the system is designed so as to prevent the entry of data points not corresponding to acceptable data points. In other words, if press speed increases, then the powder volume cannot be decreased below a previous value or a previously determined acceptable value.

Attempts to enter data outside the acceptable range result in no data entry. The prompt indicators 212–218 are lit to show the data which is required to be entered at any time.

Once a particular set of points have been saved, then unit 240 checks to determine whether or not manual entry has been requested. If not, units 242–249 perform the same functions described above for units 224–231. Otherwise, control returns to unit 219.

The flow diagram for the automatic mode of unit 239 is shown in FIG. 12.

When the automatic mode is selected, unit 260 receives control and determines whether the automatic mode is on-line or off-line. If on-line, control passes to unit 262 which senses the press feed and unit 264 determines whether the speed has changed from the previous value. If so, unit 268 receives control and calculates the powder volume from the current storage memory for the current run number, using the current speed as sensed by the unit 262.

The memory may be any type of permanent storage, and stores a plurality of points which have been previously entered, which correlates specific operating speeds in terms of sheets per hour, with specific volume of power. If the current operating speed corresponds to one of the stored points, then the counter volume is equal to the powder volume stored with that point. Otherwise, a conventional interpolation is performed in which a numerical value for powder volume is selected proportionally between stored values of powder volume or previously stored speeds immediately above and immediately below the speed sensed by the unit 262.

If the speed is not changed, unit 266 receives control and determines whether the clear button has been pressed on the keyboard (FIG. 8). If so, unit 268 receives control and performs the functions described above.

Then unit 270 receives control which determines whether the numeric keypad of the control panel has been used to enter numeric data. If so, this data corresponds to a new powder volume for the current operating speed, and unit 272 receives control and loads the buffer with the data entered through the keyboard, to establish an operating point correlating the present speed sensed by the unit 262, with the powder volume entered through the keyboard.

If unit 270 senses that no numeric data has been entered, unit 274 checks to determine whether the up button has been pressed. If so, the current powder volume is incremented by predetermined quantity, and unit 272 updates buffer with the new increased value. If unit 274 determines that the up button has not been pressed, unit 276 receives control and checks whether the down button has been pushed. If so, a decreased value for powder volume is entered into the buffer unit 272. Then unit 278 checks whether the save point has been pressed on the control panel. If so, unit 280 receives control and stores the current point data in memory. The store point data button must be pushed for this purpose, otherwise it changes speed sensed by the unit 264 which cause the buffer to be overridden with previously stored data.

Unit 282 receives control and checks whether the save run button has been depressed. If so, all of the points for the current run are stored in memory by the unit 284. Otherwise, the points which have been entered via the operation of unit 280 for the current run is not stored and the previously stored data and permanent memory for a given run number is not altered.

At the conclusion of the sequence described above, control is passed to unit 240 (FIG. 11) and the operations described above are repeated.

If the unit 260 determines that the unit is offline, control is passed to unit 286 which checks whether the end of run button or the control panel has been depressed. If so, unit 288 receives control which receives data from the keyboard and unit 290 stores the data in memory. Specifically, the operator will be prompted to enter the run number by indicator lamps 212 and 214, after which the operator will enter the run number through the numeric keypad and press the enter key. After the run number has been entered in this way, the operator will be prompted to enter sheets per hour by the illumination of lamps 212 and 216, and then the numeric data corresponding to sheets per hour will be stored in memory. After this the operation is repeated for data corresponding to powder volume, so that a specific point will be stored in memory for a specific run number.

Then unit 292 receives control and determines whether the clear run button has been depressed. If so, unit 294 receives control and prompts the operator for the run number. When the run number has been entered, through the keyboard, unit 296 receives control and clears the data stored in memory for that run number.

Unit 298 receives control and determines whether the review push button has been depressed on the panel. If so, unit 300 receives control and prompts the operator to enter a run number, after which unit 302 displays the point stored in memory in connection with the run number. The points are displayed first in terms of sheets per hour, with the numeric data being displayed in the display 210, with the indicator 216 indicating the significance of the displayed data. Then the powder volume will be displayed for that point, in the display unit 210 with the indicator 218 indicating the significance of that data. This is repeated for all the stored points.

Unit 304 then receives control and determines whether the recall run push button has been depressed. If so, unit 306 receives control and prompts the operator to enter a run number, after which the buffer is loaded with the stored data corresponding to that run number. Then unit 308 sets the on-line flag, so that unit 260 will branch to the on-line program the next time it receives control. Automatic operation then ensued for the selected run, using the stored data previously stored for that run number. Then control passes to unit 240 (FIG. 11) and the sequences described above are repeated.

It will be appreciated that numerous changes and modifications can be made to the embodiment shown herein without departing from the spirit and scope of this invention.

We claim as our invention:

1. A method for operating a powder dispensing system for use with a printing press comprising the steps of:

selectively operating said apparatus in a manual mode and in an automatic mode, in said manual mode, dispensing a selectable fixed volume of powder to a printing press, in said automatic mode, dispensing a variable volume of powder to said press in accordance with a predetermined relationship to press speed, defining a modified relationship between powder volume and press speed by selecting a first powder volume to be dispensed at a first press speed, selecting a second powder volume to be dispensed at a second press speed, and storing said selected powder volumes to define said modified relationships relating powder volume and press speed between points corresponding to said two selected powder volumes.

2. A method as in claim 1, including the step of defining said modified relationship as a linear relationship between powder dispensing rate and press speed with the powder dispensing rate being zero at zero press speed.

3. A method as in claim 1, including the step of defining said modified relationship by the entry into said system of additional data points corresponding to preselected powder dispensing rates and press speeds which are interconnected to establish said modified relationship.

4. A method as in claim 3, including the step of storing said modified relationship is stored for future reference.

5. A method as in claim 1, further including the steps of sensing operation of the machine for various predetermined conditions, comparing the sensed conditions with predetermined conditions, and if the sensed conditions are not within the prescribed tolerances of the predetermined conditions issuing an alarm.

6. Apparatus for controlling automatic dispensing of powder in response to operating speed of a printing press, comprising means for storing data corresponding to a plurality of arbitrarily selected points relating a predetermined quantity of powder with a predetermined operating speed, manually operated means for changing the stored data, means for sensing the current operating speed, and means for automatically controlling the amount of powder dispensed in accordance with the current operating speed, and means for optionally selecting a predetermined quantity of powder at a given press speed, means for selecting a different quantity of powder for dispensing at a different press speed, and means for storing said selected powder quantities to define a curve relating powder quantity dispensed with press speed.

7. Apparatus according to claim 6, including means for storing a plurality of points defining a curve relating operating speed with the quantity of powder dispensed, and means for automatically setting the powder to be dispensed at any operating speed proportionally between stored data corresponding to powder volumes corresponding to speeds above and below the current operating speed.

8. Apparatus according to claim 6, including means for selectively controlling the relation between the quantity of powder dispensed at the current operating speed without altering said stored data.

9. Apparatus according to claim 6, including means for storing a plurality of curves of different relationships between quantity of powder dispensed and operating speed, and manually operated means for selecting one of said curves for subsequent automatic dispensing of powder in accordance with one of said stored curves.

10. Apparatus according to claim 9, including manually operated means for selectively altering points on said stored curves by entering a new volume of powder for the current operating speed.

11. Apparatus according to claim 9, including manually operated means for altering said stored data for one of said curves by entering a new predetermined speed and a corresponding new volume of powder.

* * * * *